US005450914A

United States Patent [19]

Coram

[11] Patent Number: 5,450,914

[45] Date of Patent: Sep. 19, 1995

[54] FLUID POWERED STEPPING MOTOR FOR ROTATING A DOWNHOLE ASSEMBLY RELATIVE TO A SUPPORTING PIPE STRING

[75] Inventor: Walter T. Coram, Bellaire, Tex.

[73] Assignee: Precision Radius, Inc., Houston, Tex.

[21] Appl. No.: 198,981

[22] Filed: Feb. 18, 1994

[51] Int. Cl.[6] ..... E21B 7/08

[52] U.S. Cl. ..... 175/73; 175/113

[58] Field of Search ..... 175/38, 61, 73, 74, 175/108, 322, 113

[56] References Cited

U.S. PATENT DOCUMENTS

| | | | |
|---|---|---|---|
| 4,895,214 | 1/1990 | Schoeffler | 175/38 |
| 5,232,058 | 8/1993 | Morin et al. | 175/73 |
| 5,259,467 | 11/1993 | Schoeffler | 175/73 X |
| 5,311,952 | 5/1994 | Eddison et al. | 175/61 |
| 5,339,913 | 8/1994 | Rives | 175/73 |

*Primary Examiner*—Ramon S. Britts

*Assistant Examiner*—Frank S. Tsaj

*Attorney, Agent, or Firm*—Vaden, Eickenroht, Thompson & Feather

[57] ABSTRACT

A fluid powered stepping motor is disclosed for connecting to a pipe string to rotate a tool relative to the pipe string by raising and lowering the pressure in the pipe string. The motor includes a housing, the lower end of which is connected to the tool. A mandrel is connected to the pipe string and extends into the upper end of the housing to support the housing for rotation relative to the mandrel. A passageway extends longitudinally through the mandrel in fluid communication with the pipe string. A piston is located in and closes the passageway so that the piston will move downwardly in the passageway in response to fluid pressure in the passageway acting on the piston. Resilient spring resists the downward movement of the piston in the passageway, and cam members rotate the housing an incremental distance when the piston moves downwardly in the passageway.

6 Claims, 5 Drawing Sheets

FIG. 3
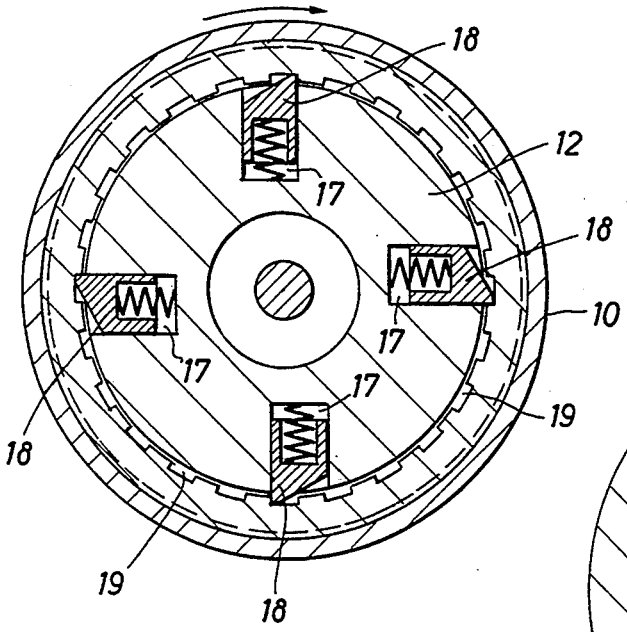
FIG. 4
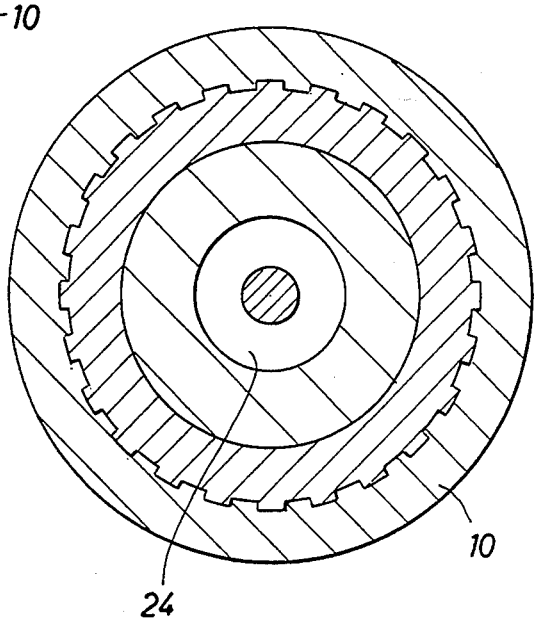
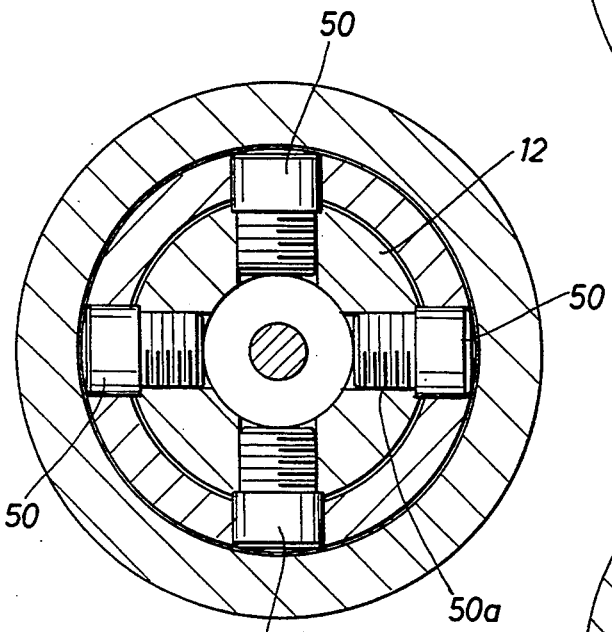
FIG. 5
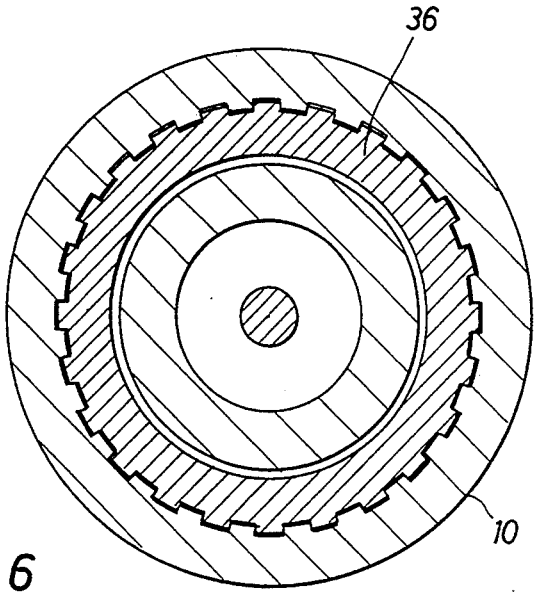
FIG. 6

FLUID POWERED STEPPING MOTOR FOR ROTATING A DOWNHOLE ASSEMBLY RELATIVE TO A SUPPORTING PIPE STRING

BACKGROUND OF THE INVENTION

This invention relates to a fluid powered stepping motor for connecting between a pipe string and a downhole assembly to rotate the downhole assembly relative to the pipe string by raising and lowering the pressure in the pipe string.

This invention has utility when located in any type of pipe string for rotating a downhole tool relative to the tubing string, but it is particularly useful for rotating a downhole tool relative to a string of coil tubing.

More and more wells are being worked over using coil tubing including the drilling of directionally controlled lateral drain holes. The tubing usually extends downwardly through the production tubing that is already in place in the well. The downhole drilling assembly includes a steering tool for indicating at the surface the inclination and direction of the drain hole and a downhole motor for rotating the drill bit. The steering tool, however, must be rotated from time to time to maintain the proper orientation of the tool with the magnetic field of the earth and coil tubing cannot be rotated.

SUMMARY OF THE INVENTION

Therefore, it is an object of this invention to provide a fluid powered stepping motor for connecting in a pipe string above a tool, such as a steering tool, that can rotate the tool relative to the pipe string by raising and lowering the fluid pressure in the pipe string.

It is a further object and feature of this invention to provide a fluid powered stepping motor for connecting between the lower end of a string of coil tubing and a downhole assembly to rotate the downhole assembly relative to the coil tubing by raising and lowering the pressure of the drilling fluid in the coil tubing.

The pressure of the drilling fluid pumped down a drill string has been used in the past to actuate downhole devices. For example, U.S. Pat. No. 5,070,950, which issued Dec. 10, 1991, describes an actuator that contains a differential piston that is biased by a helical spring in a direction opposite to that of the circulating drilling mud. As the flow rate of the drilling mud increases, thereby increasing the pressure drop across the piston, the piston is moved downwardly against the spring over a tapered throttling needle to further increase the pressure drop across the piston and the force acting on the piston. The downward movement is used to rotate a drilling tool by the step-by-step rotation of the piston with each pressure cycle. The rotation of the piston is obtained by the engagement of a serpentine groove in the outer surface of the piston with ball bearings on the coupling's inner surface. The serpentine groove in the piston has spaced parallel sections into which the balls move sequentially to cause the piston to rotate an incremental distance each time the piston is moved downwardly by the pressure drop across the piston and is returned to its upper position by a spring.

U.S. Pat. No. 4,596,294 is similar to the '950 patent in that the lower section is rotated by the engagement of pins in grooves. The rotation changes the angle between the lower section axis and the pipe string axis. Rotation is also induced in a center section, relative to the pipe string, which overcomes the angular displacement of the lower section with the result that the deviation angle of the lower section remains in a single plane.

It is a further object and advantage of this invention to provide a fluid powered stepping motor for connecting between a pipe string and a downhole assembly to rotate the assembly relative to the pipe string by raising and lowering the pressure in the pipe string, said motor comprising a housing, the lower end of which is connected to the downhole assembly, a mandrel connected to the pipe string and extending into the upper end of the housing and supporting the housing for rotation relative to the mandrel, a passageway extending longitudinally of the mandrel in fluid communication with the pipe string, a piston located in and closing the passageway so that the full fluid pressure in the passageway acts on the piston urging the piston downwardly in the passageway, resilient means resisting the downward movement of the piston in the passageway and cam means for rotating the housing an incremental distance relative to the mandrel when the piston moves downwardly.

A further object of this invention is to provide such a stepping motor that is provided with a sleeve that surrounds the mandrel and has an inclined slot in its side to engage a pin mounted on the mandrel to rotate the sleeve relative to the mandrel when the piston is moved downwardly in the passageway of the mandrel by fluid pressure causing downwardly extending ratchet teeth on the sleeve to engage upwardly extending ratchet teeth mounted on the housing and rotate the housing with the sleeve.

It is a further object and feature of this invention to provide a fluid powered stepping motor for connecting to a pipe string, such as coil tubing, to rotate a bottom hole drilling assembly, including a drill bit, a downhole motor, and a steering tool, in incremental steps to adjust the orientation of the steering tool relative to the earth's magnetic field comprising a tubular housing connected to the bottom hole assembly, a mandrel connected to the lower end of the pipe string for supporting the tubular housing and bottom hole assembly for rotation relative to the mandrel, a longitudinally extending passageway through the mandrel through which drilling fluid is pumped to the downhole motor and drill bit of the bottom hole assembly, a lower annular ratchet member positioned in the housing with a plurality of upwardly extending teeth having one straight side and one inclined side so the teeth taper upwardly, first spring means urging the lower annular ratchet member upwardly, means limiting the upward movement of the lower ratchet member and means for preventing relative rotation between the housing and the lower annular ratchet member, an upper annular ratchet member located in the housing above the lower ratchet member, said upper annular ratchet member having a plurality of downwardly extending teeth shaped to engage the teeth on the lower annular ratchet member, second spring means urging the upper annular ratchet sleeve upwardly away from the lower annular ratchet member, a piston located in the passageway through the mandrel and in engagement with the upper ratchet sleeve to move the upper ratchet sleeve downwardly against the upward forces of both spring means, and means for rotating the lower ratchet member and the housing an incremental distance as the upper ratchet sleeve moves downwardly.

It is a further object of this invention to provide such a stepping motor in which further downward movement of the piston moves the piston out of sealing engagement with the mandrel to allow drilling fluid to flow by the piston to the bottom hole drilling assembly during drilling operations.

These and other objects, advantages, and features of this invention will be apparent to those skilled in the art from a consideration of this specification, including the attached drawings and appended claims.

BRIEF DESCRIPTION OF THE DRAWINGS

FIG. 3 is a sectional view taken along line 3—3 of FIG. 1.

FIG. 4 is a sectional view taken along line 4—4 of FIG. 1.

FIG. 5 is a sectional view taken along line 5—5 of FIG. 1A.

FIG. 6 is a sectional view taken along line 6—6 of FIG. 1B.

DESCRIPTION OF THE PREFERRED EMBODIMENT

Figure 1A:
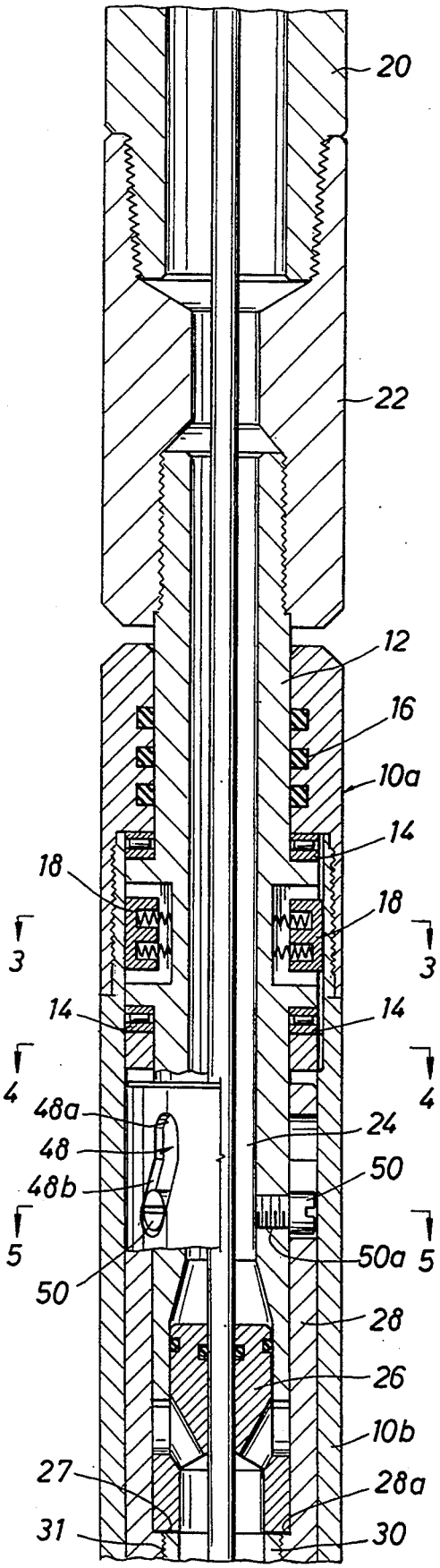
FIGS. 1A and 1B are vertical sectional views of the stepping motor of this invention with no drilling fluid being circulated through the tool.

The tool includes housing 10 that is supported on mandrel 12. Thrust bearings 14 support the housing on the mandrel for rotation relative to the mandrel. Seals 16 prevent fluid in the housing from escaping between the housing and the mandrel. For reasons that will be apparent later, spring-loaded dogs 18 are mounted in slots 17 in mandrel 12 as shown in FIG. 3, to engage vertical grooves 19 on the inner surface of housing 10 to allow rotation of the housing relative to the mandrel in a clockwise direction but to prevent relative rotation in the opposite direction.

Figure 1B:
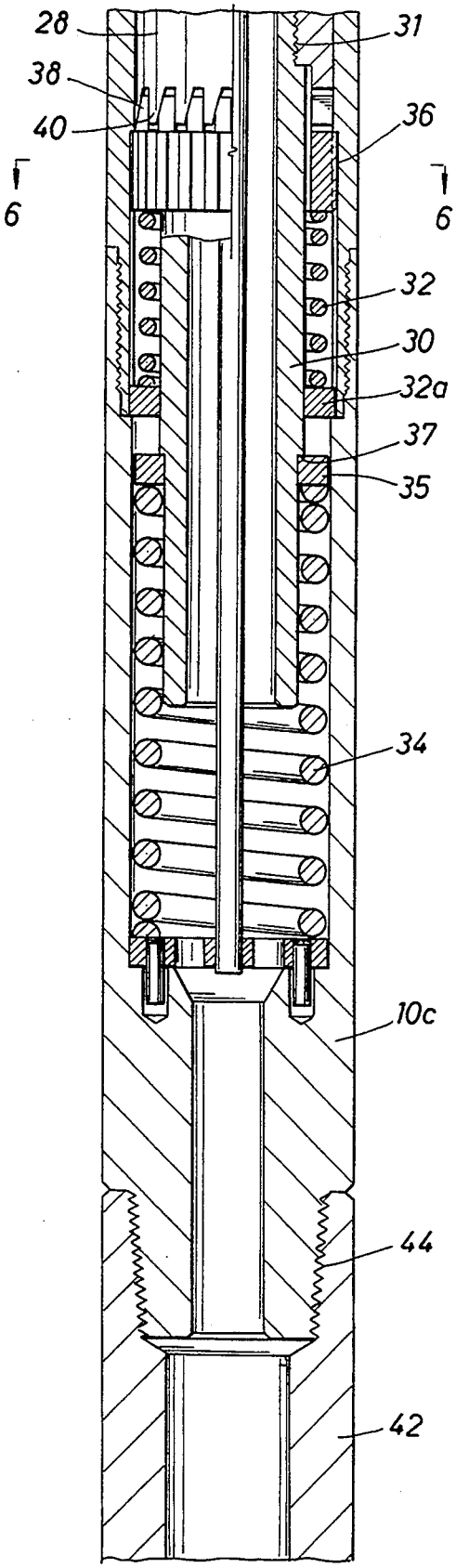

Mandrel 12 is connected to the lower end of coil tubing 20 by sub 22. Centrally located passageway 24 extends completely through mandrel 12. Piston 26, as shown in FIG. 1A, is positioned adjacent the lower end of passageway 24 closing the passageway to the flow of fluid. The piston is supported in the position shown by inner annular shoulder **28*a* on upper ratchet sleeve 28 and upper end 27 of spring sleeve 30 that is connected to ratchet sleeve 28 by threads 31. Ratchet sleeve 28 and spring sleeve 30 are supported in the position shown in FIG. 1A and FIG. 1B by second spring 34 and indexing plate 34*a*. First spring 32, the lower end of which is supported by lower ratchet spring spacer 32*a* that rests on inner shoulder 32*b* on lower housing section 10*c*, exerts an upward force on upper spring sleeve 28 through lower ratchet member 36. The lower ratchet member has upwardly extending ratchet teeth 38 that are in engagement with downwardly extending ratchet teeth 40 on the lower end of upper ratchet sleeve 28. Second spring 34 exerts an upward force on spring sleeve 30 through spring spacer 35 that engages shoulder 37** on the spring sleeve.

The lower end of housing 10 is connected to steering tool 42 of the bottom hole assembly by threaded connection 44 so rotation of housing 10 will also rotate the steering tool.

Ratchet sleeve 28 is provided with four equally spaced slots or grooves 48 having an upper portion **48*a* that is aligned with the longitudinal axis of the stepping motor and portion 48*b* that extends along a line that is at an angle to the longitudinal axis of the stepping motor. Mounted in the wall of mandrel 12 are four radially extending ratchet sleeve guide pins 50 positioned so the outer ends of each guide pin engages one of grooves 48**.

Figure 2A:
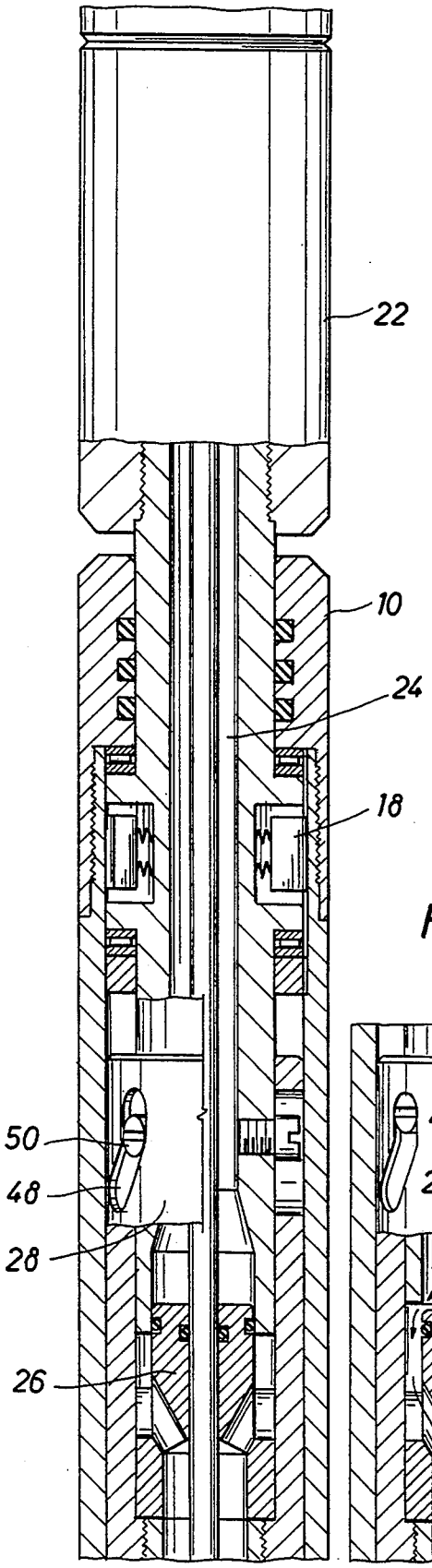
FIGS. 2A and 2B show the tool when fluid pressure has moved the piston downwardly far enough to take the first step in rotating the downhole assembly an incremental distance.
Figure 2B:
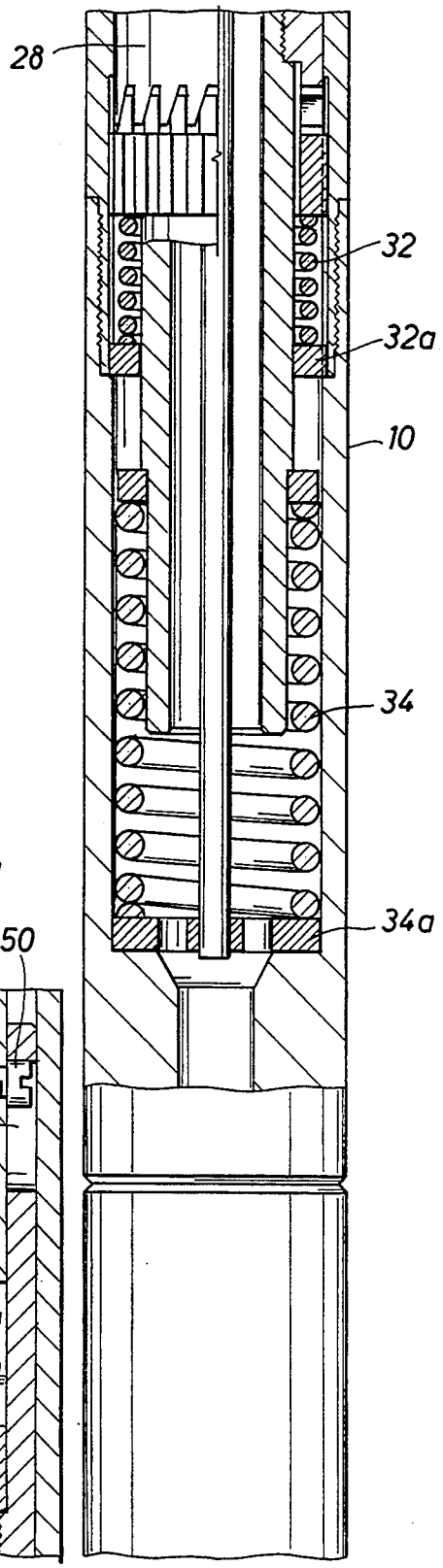

To cause the stepping motor to rotate housing 10 and the steering tool an incremental distance, fluid pressure is increased in passageway 24 forcing piston 26 downwardly to the position shown in FIG. 2A. This compresses first and second springs 32 and 34 and causes upper ratchet sleeve 28 to rotate clockwise an incremental distance due to the downward movement of slots 48 relative to guide pins 50, as shown in FIG. 2A. The downward movement of ratchet sleeve 28 relative to guide pins 50 will also exert a force tending to rotate mandrel 12 in a counterclockwise direction. But mandrel 12 cannot rotate in that direction relative to housing 10 because of lugs 18 that are in engagement with the longitudinal grooves on the inside of the housing as described above.

FIGS. 7–10 illustrate the interaction of the downwardly extending fingers on upper ratchet sleeve 28 in the upwardly extending ratchet fingers on lower ratchet member 36. Lower ratchet member 36 is provided with longitudinally extending splines **36*a* that engage longitudinally extending grooves 36*b* on the inside of housing 10 and prevent relative rotation between lower ratchet member 36** and the housing while allowing limited vertical movement between the two.

Figure 7:
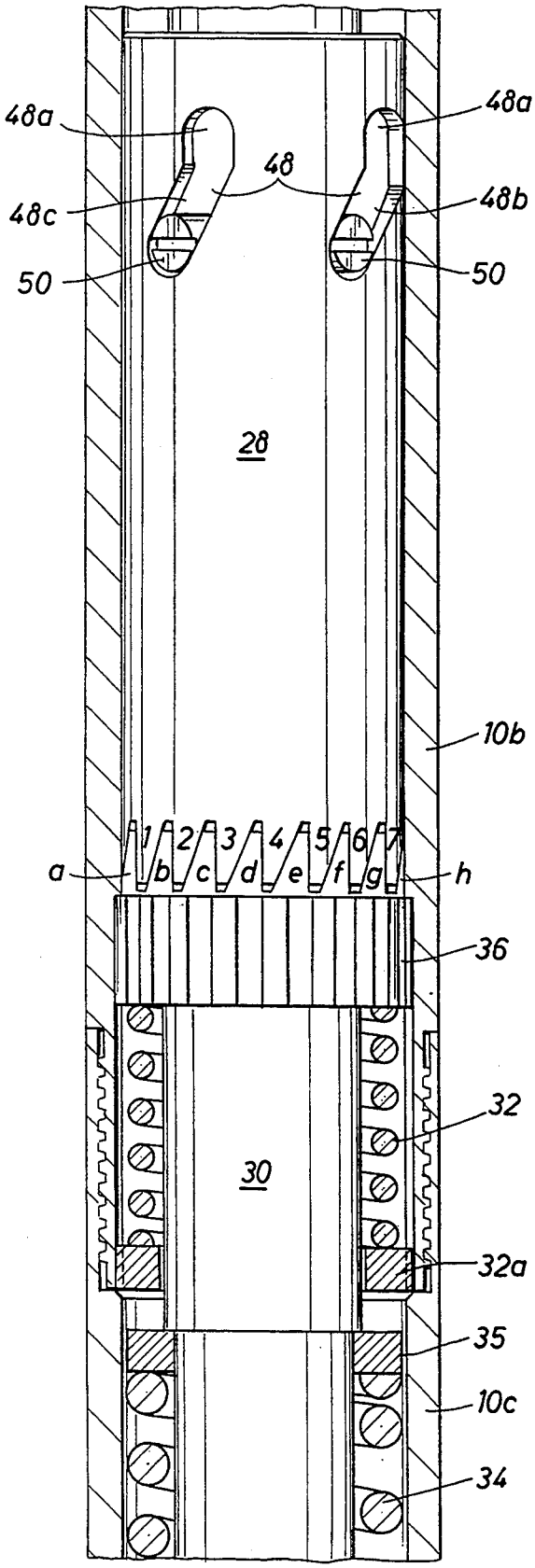

The downwardly extending fingers on upper ratchet sleeve 28 are numbered 1–7 in FIG. 7 and the upwardly extending fingers attached to lower ratchet member 36 are designated by letters a–g in FIG. 7. Each finger on both members has an inclined surface on one side and generally vertical surface on the other. When the fingers mesh as shown in FIG. 7, the inclined surfaces on the teeth of the lower ratchet member will be facing in the direction of rotation and the inclined surfaces on the teeth of the upper ratchet sleeve will be facing in the opposite direction. Conversely, the opposite is true with the other inclined and vertical engaging surfaces of the teeth.

Downward movement of sleeve 28 by the piston moves sleeve 28 downwardly causing it to rotate in order to move to the position shown in FIG. 6 with each guide pin in the upper end of portions **48*b* of the grooves and the lower ends of upper portions 48*a*. This rotation is designed to rotate sleeve 28 a distance equal to the pitch of the engaging teeth and is indicated by the letter 1 in FIG. 8. Thus, the downward movement of the piston rotates sleeve 28 and consequently lower ratchet member 36 and housing 10 a distance 1 which is an incremental distance determined by the number of ratchet teeth. In the embodiment shown, there appears to be 14** teeth total, which means that the incremental movement is 25.7°. In the preferred embodiment, the movement will probably be some even number of degrees. For example, 15° if 24 teeth are used or 20° if 18 teeth are used.

Figure 8:
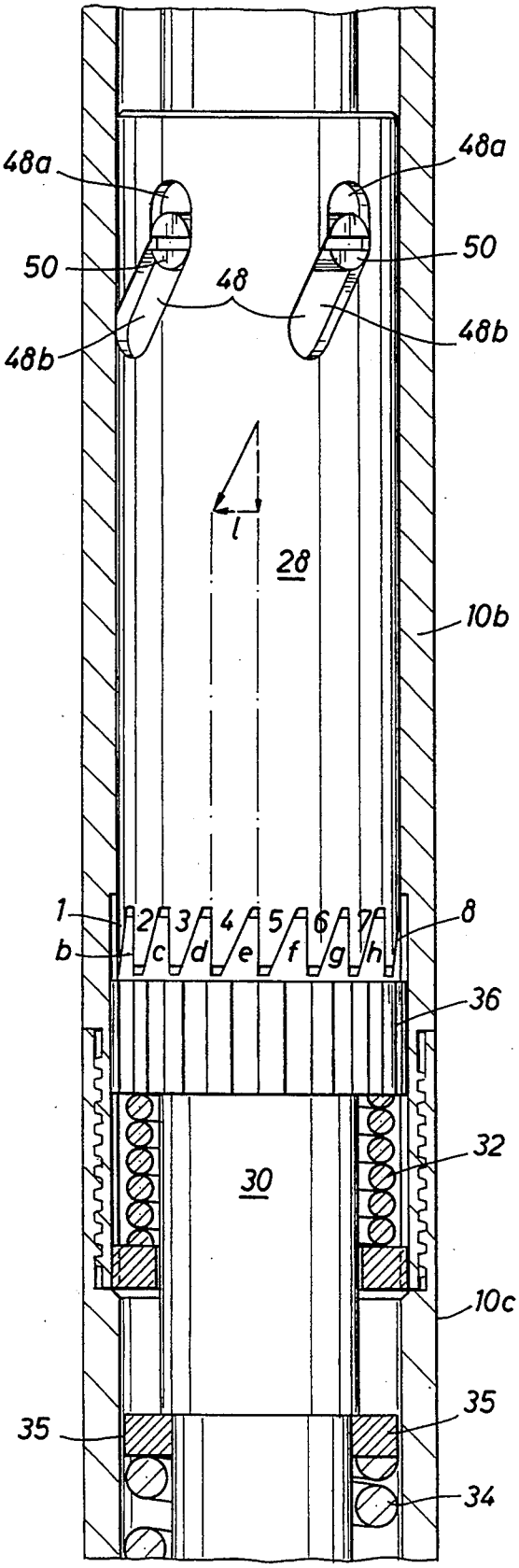
Figure 9:
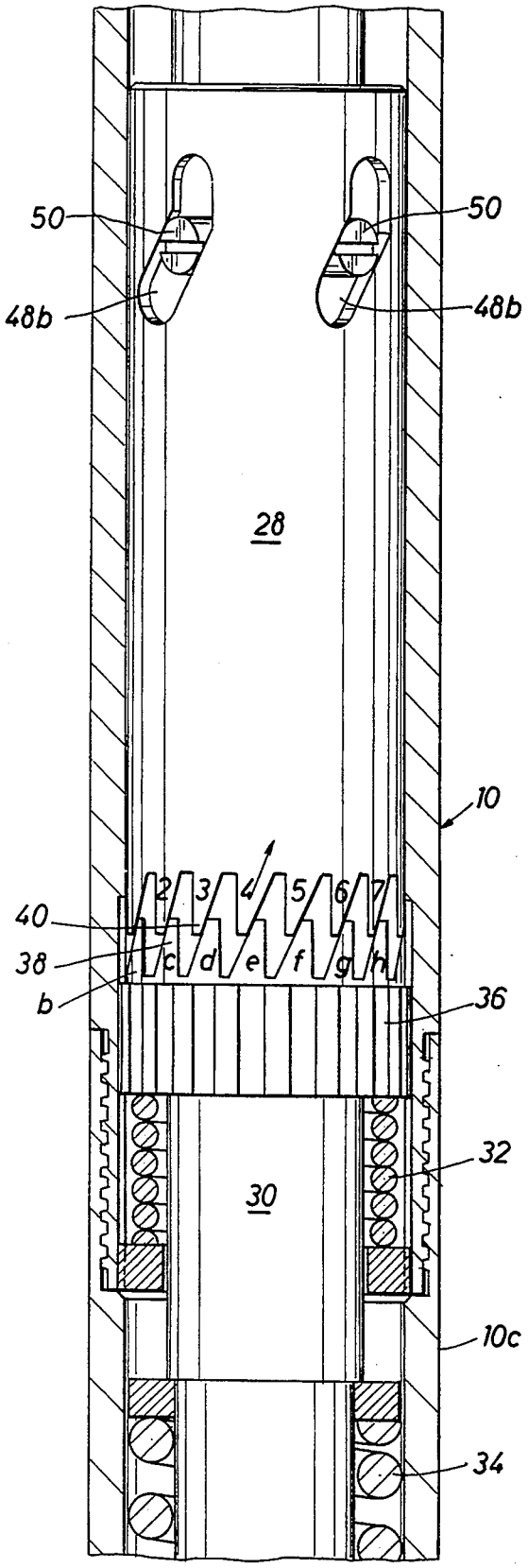

After sleeve 28 has been rotated to the position shown in FIG. 8, both springs, upper spring 32 and lower spring 34 are compressed. Pressure on the piston is reduced in passageway 24 above the piston allowing it to return to the position shown in FIG. 1A. As the pressure is released, spring 34 is sufficiently stronger than spring 32 that it will keep spring 32 compressed while holding the inclined surfaces of the ratchet teeth in firm engagement with each other to the extent that the downward component exerted on the inclined surfaces of the lower teeth by the inclined surfaces on the upper teeth will keep upper spring 32 compressed. This allows the upper teeth and ratchet sleeve 28 to move upwardly while holding the lower teeth and the lower ratchet sleeve against such movement.

Figure 10:
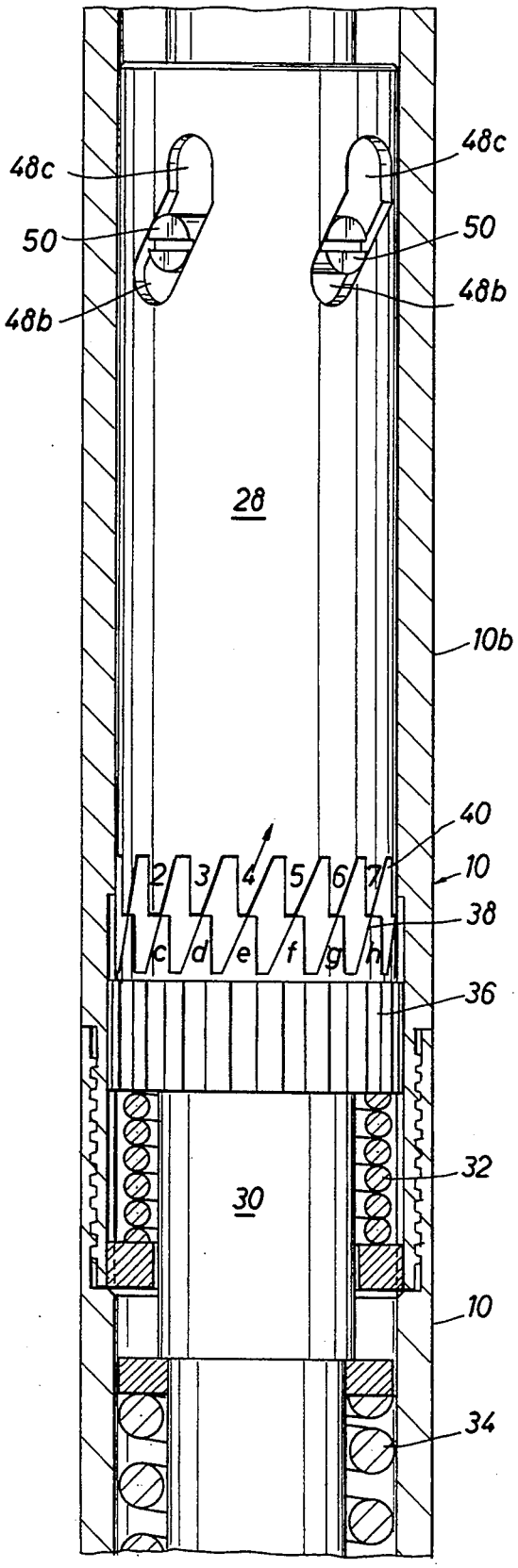

When the upper teeth clear the upper end of the lower teeth, as shown in FIG. 10, sleeve 28 will rotate rapidly counterclockwise while spring 34 moves sleeve 28 upwardly, moving the guide pins to the bottom of the grooves, as shown in FIG. 7. This allows upper spring 32 to move lower ratchet member upwardly, which moves the upwardly extending teeth on the lower ratchet member back into full engagement with the ratchet teeth on the upper ratchet sleeve, as shown in FIG. 7. The cycle is repeated if additional rotation of the steering tool is required.

Figure 11:
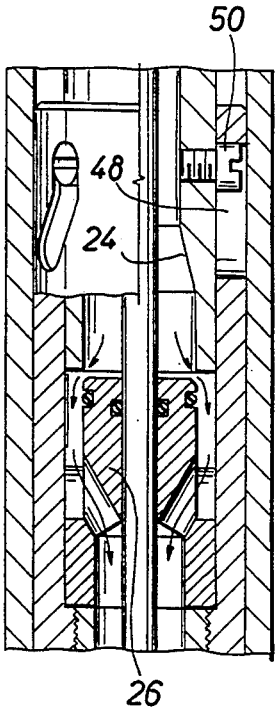
FIGS. 7, 8, 9, 10 and 11 are sectional views illustrating the relative movement of the upper ratchet sleeve and the lower ratchet member as the tool rotates the bottom hole drilling assembly an incremental distance in a clockwise direction.

If, after the downward movement of upper ratchet sleeve 28, the steering tool is in the desired angular orientation pressure in passageway 24 is increased to move piston 26 downwardly far enough to clear the bottom end of ratchet sleeve 28 and move guide pins 50 to the upper end of grooves 48, thereby allowing drilling fluid to be circulated downwardly through the stepping motor, as shown in FIG. 11, and supply the drilling motor the volume of drilling fluid required to rotate the bit so drilling can continue.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A fluid powered stepping motor for connecting in a pipe string, with portions of the pipe string extending above and below the motor, to rotate the portion of the pipe string below the stepping motor relative to the portion of the string above the motor by raising and lowering the pressure in the pipe string, said motor comprising a housing having upper and lower ends connected to the pipe string below the motor, a mandrel connected to the portion of the pipe string above the motor, said mandrel extending into the upper end of the housing and supporting the housing for rotation relative to the mandrel, a passageway extending longitudinally of the mandrel in fluid communication with the pipe string, a piston located in and closing the passageway to move downwardly in the passageway in response to fluid pressure in the passageway acting on the piston, and ratchet means for rotating the housing relative to the mandrel including resilient means resisting the downward movement of the piston in the passageway, and cam means for rotating the housing an incremental distance when the piston moves downwardly.

2. The stepping motor of claim 1 in which the ratchet means includes a sleeve surrounding the mandrel, an inclined slot in the sleeve and a pin mounted on the mandrel and engaging the slot to rotate the sleeve when the piston is moved downwardly in the passageway of the mandrel by fluid pressure engaged downwardly extending ratchet teeth on the sleeve and upwardly extending ratchet teeth mounted on the housing that engage and rotate the housing with the sleeve.

3. A fluid powered stepping motor for connecting to a pipe string to rotate a bottom hole drilling assembly connected to the pipe string and located in a well bore that is inclined from the vertical so that along a vertical axis one side of the well bore will be higher than the other side, including a drill bit, a downhole motor, and a steering tool, in incremental steps to adjust the orientation of the steering tool relative to the high side of the well bore comprising a tubular housing connected to the bottom hole assembly, a mandrel connected to the end of the pipe string, said mandrel extending into and supporting the tubular housing and bottom hole assembly for rotation relative to the mandrel, a longitudinally extending passageway through the mandrel through which drilling fluid is pumped to the downhole motor and drill bit of the bottom hole assembly, a lower annular ratchet member positioned in the housing with a plurality of upwardly extending teeth having one straight side and one inclined side so the teeth taper upwardly, first spring means urging the lower annular ratchet member upwardly, means limiting the upward movement of the lower annular ratchet member and means for preventing relative rotation between the housing and the lower annular ratchet member, an upper annular ratchet sleeve located in the housing above the lower annular ratchet member, said upper annular ratchet sleeve having a plurality of downwardly extending teeth shaped to engage the teeth on the lower annular ratchet member, second spring means urging the upper annular ratchet sleeve upwardly away from the lower annular ratchet member, a piston located in the passageway through the mandrel and in engagement with the upper annular ratchet sleeve to move the upper annular ratchet sleeve downwardly against the upward forces of both spring means, and means for rotating the lower annular ratchet member and the housing an incremental distance as the upper ratchet sleeve moves downwardly.

4. The stepping motor of claim 3 in which further downward movement of the piston moves the piston out of sealing engagement with the mandrel to allow drilling fluid to flow by the piston to the bottom hole drilling assembly during drilling operations.

5. The stepping motor of claim 3 in which the means for rotating the lower annular ratchet member and the housing as the upper annular ratchet sleeve is moved downwardly by the piston includes an inclined groove in the upper annular ratchet sleeve and a guide pin attached to the mandrel and engaging the groove to rotate the upper annular ratchet sleeve an incremental distance in one direction relative to the mandrel and, through the engagement of the ratchet teeth, the lower annular ratchet sleeve as the piston moves the upper annular ratchet sleeve downwardly compressing the second spring means, and means for preventing the lower annular ratchet sleeve and housing from rotating relative to the mandrel in the other direction whereby when the pump pressure is released the first spring means will hold the inclined surfaces of the lower annular ratchet teeth firmly against the inclined surfaces of the upper annular ratchet teeth as the second spring means moves the upper annular ratchet sleeve upwardly causing the pins and the grooves to rotate the sleeve back to its original position where the teeth move out of engagement allowing the upper annular ratchet sleeve to rotate back to its original position and allowing the first spring to move the ratchet teeth back into engagement.

6. A fluid powered stepping motor for connecting to a pipe string to rotate a bottom hole drilling assembly, including a drill bit, a downhole motor, and a steering tool in incremental steps to adjust the orientation of the steering tool to the high side of the well bore comprising a tubular housing connected to the bottom hole drilling assembly, a mandrel connected to the pipe string, said tubular housing and bottom hole assembly being mounted on the mandrel for rotation relative to the mandrel, a longitudinally extending passageway through the mandrel through which drilling fluid is pumped to the downhole motor and drill bit of the bottom assembly, a lower annular ratchet member positioned in the housing with a plurality of upwardly extending teeth having one straight side and one inclined side so the teeth taper upwardly, first spring means urging the lower annular ratchet member upwardly, means limiting the upward movement of the lower ratchet member and means for preventing relative rotation between the housing and the lower annular ratchet member, an upper annular ratchet member located in the housing above the lower annular ratchet member, said upper annular ratchet member having a plurality of downwardly extending teeth shaped to engage the teeth on the lower annular ratchet member, second spring means urging the upper annular ratchet sleeve upwardly away from the lower annular ratchet member, a piston located in the passageway through the mandrel and in engagement with the upper annular ratchet sleeve to move the upper annular ratchet sleeve downwardly against the upward forces of both spring means, and means for rotating the lower annular ratchet member and the housing an incremental distance as the upper annular ratchet sleeve moves downwardly, said means including an inclined groove in the upper annular ratchet sleeve and a guide pin attached to the mandrel and engaging the groove to rotate the upper annular ratchet sleeve an incremental distance in one direction relative to the mandrel and, through the engagement of the ratchet teeth, the lower annular ratchet sleeve as the piston moves the upper annular ratchet sleeve downwardly, and means for preventing the lower annular ratchet sleeve and housing from rotating relative to the mandrel in the other direction whereby when the pump pressure is released the first spring means will hold the inclined surfaces of the lower annular ratchet firmly against the inclined surfaces of the upper annular ratchet as the second spring means moves the upper annular ratchet sleeve upwardly causing the pins and the grooves to rotate the sleeve back to the first position where the teeth move out of engagement allowing the upper annular ratchet sleeve to rotate back to its original position and allowing the first spring to move the ratchet teeth back into engagement having rotated the lower annular ratchet sleeve, the housing, and the downhole assembly the width of one tooth.

* * * * *